United States Patent [19]

Bohne et al.

[11] 4,212,432

[45] Jul. 15, 1980

[54] COMMINUTING MACHINE AND HOUSING WITH A ROTOR JOURNALLED IN THE HOUSING AND A TOOL CONNECTED TO THE HOUSING

[75] Inventors: Günther Bohne, Düsseldorf; Bernhard Brans, Oberhausen; Haribert Hannebauer; Manfred Helfenbein, both of Düsseldorf; Jürgen Theobald, Korschenbroich, all of Fed. Rep. of Germany

[73] Assignee: Lindemann Maschinenfabrik GmbH, Düsseldorf, Fed. Rep. of Germany

[21] Appl. No.: 727,941

[22] Filed: Sep. 29, 1976

[30] Foreign Application Priority Data

Oct. 1, 1975 [DE] Fed. Rep. of Germany ..... 2543769

[51] Int. Cl.[2] ..... B02C 13/04

[52] U.S. Cl. ..... 241/285 B

[58] Field of Search ..... 241/189 R, 189 A, 190, 241/285 A, 285 B

[56] References Cited

U.S. PATENT DOCUMENTS

| | | | |
|---|---|---|---|
| 672,951 | 4/1901 | Merrick | 241/285 A UX |
| 672,952 | 4/1901 | Merrick | 241/285 A UX |
| 1,602,622 | 10/1926 | London | 241/285 B UX |
| 3,545,690 | 12/1970 | Burian et al. | 241/285 B X |
| 3,677,478 | 7/1972 | Schutte | 241/189 R X |

FOREIGN PATENT DOCUMENTS

| | | | |
|---|---|---|---|
| 2019384 | 11/1971 | Fed. Rep. of Germany | 241/285 A |

*Primary Examiner*—Howard N. Goldberg

*Attorney, Agent, or Firm*—Toren, McGeady and Stanger

[57] ABSTRACT

A comminuting machine includes a rotor which is rotatably journalled about an axis in a housing having at least two parts which are connected by a hinge, with the axis of hinge being parallel to the rotor axis. Each journal bearing of the rotor includes a bearing casing which is arranged to be connected to either one or the other part of the two part housing, so that, during maintenance of the machine the two parts of the housing are swung apart and the rotor with the bearing casing is connected to either one or the other part. In this way access is allowed to either of the parts of the housing and to the rotor for maintenance of the machine.

4 Claims, 3 Drawing Figures

COMMINUTING MACHINE AND HOUSING WITH A ROTOR JOURNALLED IN THE HOUSING AND A TOOL CONNECTED TO THE HOUSING

This invention relates to a comminuting machine, in which a rotor equipped with breaking tools revolves within a housing and co-operates with further breaking tools fixed to the housing. These machines are used for breaking scrap material, for example metal scrap, and the breaking tools of such machines, and indeed all the other components inside the housing, are subjected to considerable wear and therefore require frequent maintenance, either by building up metal by welding or by complete replacement. For this purpose, the housing is arranged so that its upper part is removeable. If the parts to be repaired or replaced are situated in the lower part of the housing, it is also necessary to remove the rotor.

The lifting equipment required for this work, especially for lifting out the rotor which is heavy, is frequently not available, for example on open scrap-handling areas. To help overcome this problem Published German Specification 2019384 proposes journalling the rotor in the upper part of the machine housing and then connecting the upper part to the lower part by a pivot situated at the side, with a simple hydraulic drive between the two parts for lifting up the upper part of the housing with the rotor mounted therein and thereby for providing access to some extent at least into the interior of the lower part of the housing for maintenance. This indeed does facilitate the maintenance and repair of the fixed breaking tools and other components in the lower part of the housing which are subjected to wear. However it is no longer possible to gain access to the components which are subjected to wear and which are situated in the upper part of the housing.

According to this invention a comminuting machine comprises a rotor which is rotatably journalled about an axis in a housing having at least two parts which are connected by a hinge the axis of which is parallel to the rotor axis. Each journal bearing of the rotor includes a bearing casing arranged to be connected to either one or the other part of the two part housing, so that, during maintenance of the machine the two parts of the housing are swung apart and the rotor with the bearing casing is connected to either one or the other of the parts whereby access is allowed to either of the parts and to the rotor.

Preferably each journal bearing includes two flanges, one arranged to be connected to one part of the housing and the other arranged to be connected to the other part of the machine.

It is also preferred that the axis of the hinge and the axis of the motor lie in mutually parallel horizontal planes, which are at most only a short vertical distance from one another. Then the angle of pivot which is necessary to expose the lower part of the housing when the upper part is raised to facilitate the necessary repairs, is then kept to its practical minimum. This also means that the force required for pivoting the upper part of the housing together with the heavy rotor is then also kept to a minimum. This advantage is not offered, for example, by the machine shown in German Published Specification No. 20 19 384, since with that arrangement, even when the upper part of the housing is fully opened, the rotor still obstructs the path of a lifting device penetrating vertically from above into the lower part of the housing.

Thus this invention provides a comminuting machine in which all components which are subjected to wear, whether movable or fixed, can be exposed for maintenance without the assistance of heavy lifting tackle.

A particular example of a comminuting machine in accordance with this invention will now be described with reference to the accompanying drawings; in which.

Figure 1:
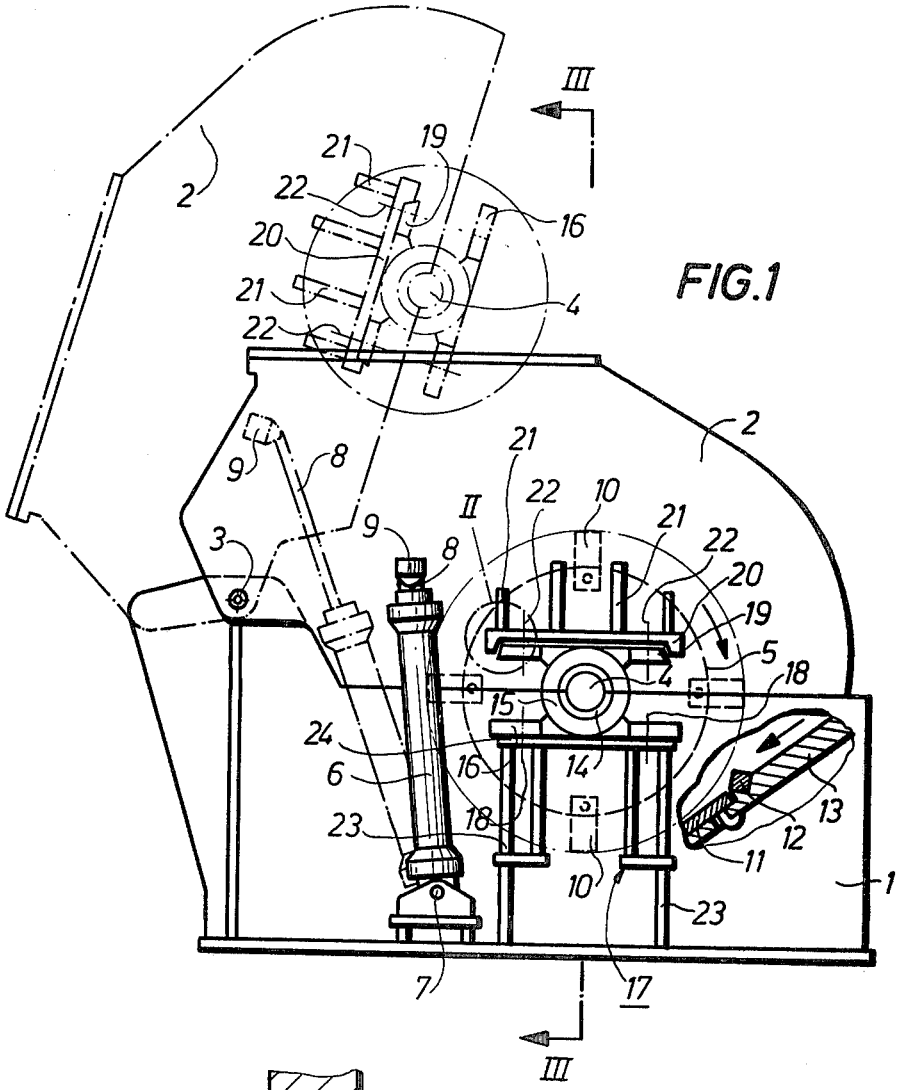
FIG. 1 is a partly sectioned side elevation showing the raised upper part of the housing in chain-dotted lines.

The comminuting machine shown in FIG. 1 consists of a two-part housing having a stationary lower part 1 and an upper part 2, which is connected to the lower part 1 by a hinge 3 having its axis horizontal. A rotor 5 is mounted in the housing and is rotatably driven by a motor, not shown, through a shaft 4. The axis of the shaft 4 is parallel to the axis of hinge 3. The two axes are separated laterally from each other by a considerable distance and both lie in horizontal planes which are closely spaced in the vertical direction. Releasable, screw-threaded bolts, not shown, are also provided, which connect the parts 1 and 2 of the housing together, when the machine is operating.

The hinge 3 enables the upper part 2 of the housing to be swung into the position shown by chain-dotted lines after the screw-threaded bolts have been undone, to enable maintenance operations to be carried out. The pivoting of the upper part 2 is effected by a pair of hydraulic cylinder-piston assemblies, situated one on each side of the housing. The cylinder 6 of each assembly is pivotally connected on the lower part 1 of the housing by a trunnion 7, and the piston rod 8 of each assembly is connected by a pivot 9 to the upper part 2 of the housing.

Figure 3:
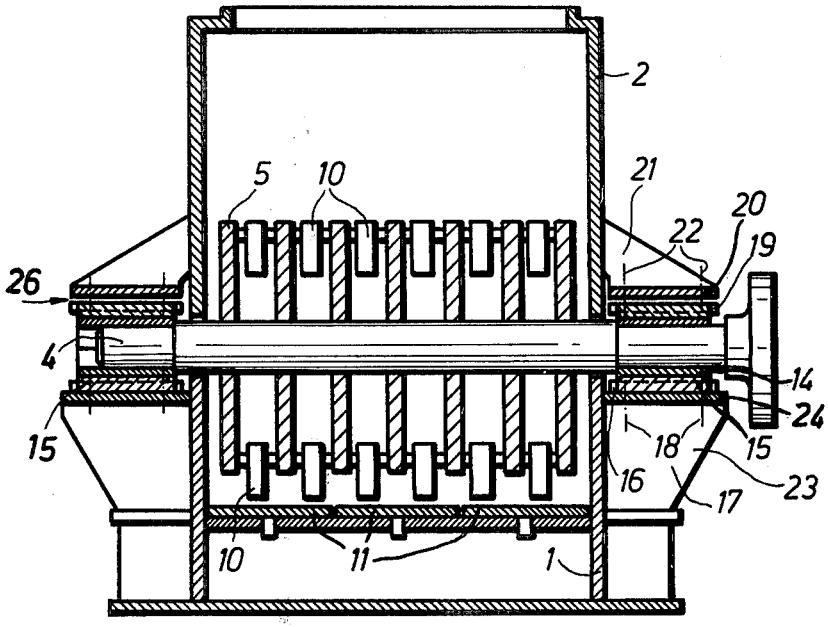

The rotor 5 is rotatably journalled in the housing 1, 2, and is indicated by chain-dotted lines in FIG. 1. The rotor is equipped with breaker tools, in the form of hammers 10 around its periphery and this is shown in FIG. 3. The housing is internally lined with wear plates 11, against which the material being comminuted is thrown and conveyed to an outlet. The material to be comminuted is supplied through a chute 13 and disintegrated between the hammers 10 and an anvil 12, mounted in the part 2 of the housing.

The shaft 4 is rotatably mounted at each end in a journal bearing 14, which is mounted in a bearing casing 15 having a flange 16, which rests upon a bearing pedestal 17 formed by vertical plates 23 and a plate 24 which are fixed externally on to the lower part 1 of the housing. In normal operation, the flange 16 is bolted to the bearing pedestal 17 by bolts 18. A rigid connection between the bearing casing 15 and the upper part 2 of the housing is not made during normal operation of the machine.

After a period of operation, when maintenance of the machine is necessary, the rotor 5 may remain in its basic position, that is in the position shown in FIGS. 1 and 3 inside the lower part of the housing and then the upper part 2 of the housing is moved into the position shown in FIG. 1 by the chain-dotted lines by the hydraulic piston and cylinder assemblies and the part 2 pivots about the hinge 3 through approximately 90°. In this state maintenance can be carried out on the upper part 2 of the housing without the rotor 5 being in the way. It is also possible for the rotor 5, which remains in the lower part 1 of the housing, to be maintained by being equipped with new hammers 10 and to be repaired by building up material by welding at the worn positions.

However, it is usually more important to expose the lower part 1 of the housing by removing the rotor 5, and then the upper part 2 of the housing together with the rotor is raised upwards by the hydraulic drive into the position shown in chain-dotted lines in FIG. 1. In this way, all parts which are situated in the lower part of the housing are exposed and can be maintained. The arrangement of the axes of the rotor shaft 4 and the hinge 3 at approximately the same height and at a considerable distance apart, together with an opening angle of the order of 90°, makes the lower part 1 of the housing accessible from above through a wide opening, so that maintenance can be carried out without difficulty.

To enable the rotor 5 together with bearing casings 15 and shaft 4 to be brought into the raised position each bearing casing 15 is equipped with a further flange 19 and this is bolted to a plate 20 attached to the upper part 2 of the housing by stiffening ribs 21. The flange 19 is attached at the positions 22, shown by broken lines in FIGS. 1 and 3 by screw-threaded bolts passing through holes, shown in FIG. 2. Thus after unscrewing the bolts 18 and connecting the flange 19 to the plate 20, the upper part 2 of the housing together with the rotor 4 and the bearing casing 15 is raised from the bearing pedestal 17, and brought into the upwardly pivoted position by operating the hydraulic drive.

Figure 2:
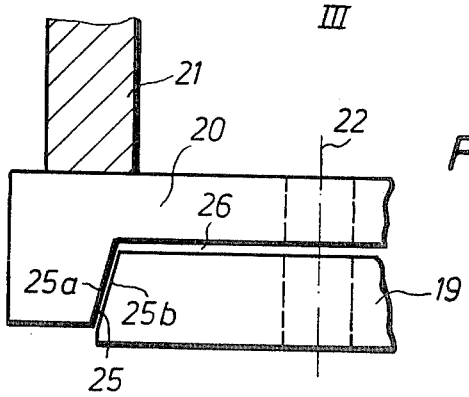
FIG. 2 is a detail to a considerably larger scale of the part within the circle II shown in FIG. 1; and, FIG. 3 is a longitudinal section taken along the line III—III shown in FIG. 1.

When the upper part of the housing is brought back into the normal operating position, to ensure that all parts again adopt their original positions and do not need to be set up again, inclined surfaces 25*a* and 25*b* are provided on the flange 19 and the associated plate 20 as shown in FIGS. 2 and 3. An inclined gap 25 is formed between these centering surfaces 25*a*, 25*b*, which produce a true centering action as the screw-threaded bolts 22 are tightened. Once the rotor is again supported on the bearing pedestal 17 gaps 25 and 26 exist between the flange 19 and the plate 20 and these prevent impacts and vibrations from being transmitted from the upper part 2 of the housing to the bearing casing 15.

We claim:

1. In a comminuting machine comprising a two-part housing, a rotor journalled for rotation within said housing, journal means including a bearing casing for rotatably journalling said rotor about an axis in said housing, and a hinge pivotally connecting said two parts together whereby said two parts are separable for maintenance, tools secured to said rotor for rotation therewith, means stationarily mounted in at least one part of said two-part housing for interacting with said tools in effecting the comminuting action, the improvement wherein said bearing casing of said journal means of said rotor is selectively supported in either of said two parts forming said housing whereby said rotor with said bearing casing and said tools connected thereto is located in either of said parts of said two-part housing when said parts are separated for maintenance so that access is available to said rotor and said means stationarily mounted in at least one part of said two-part housing.

2. In a comminuting machine comprising a two-part housing, a rotor journalled for rotation within said housing, journal means including a bearing casing for rotatably journalling said rotor about a horizontal axis in said housing, and a hinge pivotally connecting said two parts together about an axis parallel to and spaced from the horizontal axis of said rotor whereby said two parts are separable for maintenance, the improvement wherein said two-part housing comprises a stationary lower part and an upper part pivotally displaceable about the hinge axis relative to said lower part, at least one first tool secured on said rotor for rotation therewith, the interior of said two-part housing forming a circumferential peripheral surface, at least one second tool secured on said circumferential peripheral surface with said second tool interacting with said first tool as said rotor rotates, said bearing casing of said hournal means of said rotor is selectively supported in either of said upper and lower parts forming said housing whereby said rotor with said bearing casing connected thereto is located in either of said pivotally displaceable upper part or said stationary lower part of said two-part housing when said upper part is pivotally displaced from said lower part for affording maintenance of said rotor, said first and second tools and the peripheral surface formed by said upper and lower parts.

3. In a comminuting machine comprising a two-part housing, a rotor journalled for rotation within said housing, journal means including a bearing casing for for rotatably journalling said rotor about a horizontal axis in said housing, and a hinge pivotally connecting said two parts together about an axis parallel to and spaced from the horizontal axis of said rotor whereby said two parts are separable for maintenance, the improvement wherein said two-part housing comprises a stationary lower part and an upper part pivotally displaceable about the hinge axis relative to said lower part, at least one first tool secured on said rotor for rotation therewith, the interior of said two-part housing forming a circumferential peripheral surface, at least one second tool secured on said circumferential peripheral surface with said second tool interacting with said first tool as said rotor rotates, said bearing casing of said journal means of said rotor is selectively supported in either of said upper and lower parts forming said housing whereby said rotor with said bearing casing connected thereto is located in either of said pivotally displaceable upper part or said stationary lower part of said two-part housing when said upper part is pivotally displaced from said lower part for affording maintenance of said rotor, said first and second tools and the peripheral surface formed by said upper and lower parts, and said hinge axis spaced radially outwardly from the circumferential peripheral surface and located within the range of the horizontal plane containing said rotor axis and the vertical height of said upper part.

4. In a comminuting machine comprising a two-part housing, a rotor journalled for rotation within said housing, journal means including a bearing casing for rotatably journalling said rotor about a horizontal axis in said housing, and a hinge pivotally connecting said two parts together about an axis parallel to and spaced from the horizontal axis of said rotor whereby said two parts are separable for maintenance, the improvement wherein said two-part housing comprises a stationary lower part and an upper part pivotally displaceable about the hinge axis relative to said lower part between a closed position and an open position with the plane of separation of said upper and lower parts in the closed position being horizontal and including the axis of said rotor, at least one first tool secured on said rotor for rotation therewith, the interior of said two-part housing forming a circumferential peripheral surface, at least one second tool secured on said circumferential peripheral surface with said second tool interacting with said first tool as said rotor rotates, said bearing casing of said journal means of said rotor is selectively supported in either of said upper and lower parts forming said housing whereby said rotor with said bearing casing connected thereto is located in either of said pivotally displaceable upper part or said stationary lower part of said two-part housing when said upper part is pivotally displaced from said lower part for affording maintenance of said first and second tools and the peripheral surface formed by said upper and lower parts, said first tool defining a circular path as said rotor rotates with said path spaced closely inwardly from the circumferential peripheral surface of said two-part housing, and said hinge axis spaced a considerable distance outwardly from the circumferential peripheral surface and located in the vertical range upwardly from the plane of separation of said upper and lowr parts for the vertical height of said upper part.

* * * * *